US012618216B2

(12) United States Patent
Li et al.

(10) Patent No.: US 12,618,216 B2
(45) Date of Patent: May 5, 2026

(54) SLOPE REINFORCING AND PROTECTING DEVICE FOR HYDRAULIC ENGINEERING

(71) Applicant: Anhui Agricultural University, Hefei (CN)

(72) Inventors: Chun Li, Hefei (CN); Zhiliang Yang, Hefei (CN); Zhaoxue Wu, Hefei (CN); Xiaoyu Wang, Hefei (CN); Xiaole Wang, Hefei (CN)

(73) Assignee: Anhui Agriculture University, Hefei City (CN)

( * ) Notice: Subject to any disclaimer, the term of this patent is extended or adjusted under 35 U.S.C. 154(b) by 175 days.

(21) Appl. No.: 18/602,051

(22) Filed: Mar. 12, 2024

(65) Prior Publication Data

US 2024/0309600 A1 Sep. 19, 2024

(30) Foreign Application Priority Data

Mar. 14, 2023 (CN) ..... 202310240532.1

(51) Int. Cl.

| | |
|---|---|
| ***E02D 17/20*** | (2006.01) |
| ***E02B 11/02*** | (2006.01) |
| ***E02D 5/80*** | (2006.01) |

(52) U.S. Cl.
CPC ..... *E02D 17/20* (2013.01); *E02B 11/02* (2013.01); *E02D 2600/20* (2013.01)

(58) Field of Classification Search
CPC ..... E02B 11/02; E02D 17/20; E02D 17/202
See application file for complete search history.

(56) References Cited

U.S. PATENT DOCUMENTS

| | | | | |
|---|---|---|---|---|
| 2024/0044096 | A1* | 2/2024 | Eicher | E02D 5/801 |
| 2024/0191451 | A1* | 6/2024 | Lipscomb | E02D 5/803 |

FOREIGN PATENT DOCUMENTS

| | | | | |
|---|---|---|---|---|
| CN | 216339332 U | * | 4/2022 | |
| CN | 115434342 A | * | 12/2022 | E21B 7/00 |
| KR | 20010055376 A | * | 7/2001 | E01F 7/045 |
| KR | 101150125 B1 | * | 6/2012 | E02D 17/20 |
| WO | WO-2015062905 A1 | * | 5/2015 | E02D 17/202 |

* cited by examiner

*Primary Examiner* — Amber R Anderson
*Assistant Examiner* — Stacy N Lawson

(57) ABSTRACT

The present disclosure provides a slope reinforcing and protecting device for hydraulic engineering. The device includes a connecting base body, where an upper end of the connecting base body is fixedly connected to a protection assembly, and a fastening assembly is arranged in the protection assembly for supporting. A protection net is connected around an outer side of the connecting base body.

10 Claims, 8 Drawing Sheets

SLOPE REINFORCING AND PROTECTING DEVICE FOR HYDRAULIC ENGINEERING

TECHNICAL FIELD

The present disclosure belongs to the technical field of slope surface protection, and in particular to a slope reinforcing and protecting device for hydraulic engineering.

BACKGROUND

The description in this section merely provides background information relevant to the disclosure of the present application and does not constitute the prior art.

Slope protection refers to the general term for all kinds of paving and planting on a slope surface to prevent the slope from being eroded. A slope protection device is widely used in the topography with steep slopes and slopes that are likely to lose soil and sand. The slope protection device is commonly used in hydraulic engineering construction. Common slope protection devices include slope protection bricks, etc., which can effectively prevent soil erosion or slope way subsidence, and play a vital role in the construction of ecological hydraulic engineering. Although an existing slope protection brick has good integrity, a large amount of manpower and material resources are needed, and time and labor are wasted. A slope way arranged is likely to subside after being used for a period of time, which will cause environmental pollution.

Existing patents provide certain solutions, such as the patent with No. JP2004003257A, which provides a plate body and a method for fixing a column body. The plate body is fixed on a slope surface, and since a plurality of hole grooves are provided in a surface of the plate body, flowers, grass, etc. can be planted in the hole grooves for reinforcing and protecting the slope surface. However, this solution fails to achieve the purpose of quick replacement when problems occur, and time and labor are still consumed. Here, the inventor believes that there is still much room for improvement.

It should be noted that the above description of the background art is only for the convenience of clear and complete description of the technical solutions of the present application and for the convenience of understanding by those skilled in the art. The technical solutions described above should not be considered known to those skilled in the art merely because these solutions are set forth in the background art section of the present application.

SUMMARY

In order to solve the above problems that mounting of a slope surface protection device is time-consuming and laborious, and the device is inconvenient to transfer in case of an emergency, the present disclosure provides a slope reinforcing and protecting device for hydraulic engineering. The device includes a connecting base body. An upper end of the connecting base body is fixedly connected to a protection assembly, a fastening assembly is arranged in the protection assembly for supporting, and a protection net is connected around an outer side of the connecting base body. Further, a second column body of the fastening assembly is buried in soil, and a first column body is partially exposed.

The connecting base body is of a square body, and the center of the connecting base body is provided with an octagonal boss. The center of the boss is provided with a first through hole, the boss is at a certain angle, and a drainage groove is provided around the first through hole. Trapezoidal notches are provided in both sides of the connecting base body, and a plurality of retaining rings are fixedly connected to a side edge of the connecting base body.

Further, water flow outlets of the drainage groove in the surface of the connecting base body are the notches at two sides, and the purpose of arranging the drainage groove is that rainwater can drop to the ground along the drainage groove when rainstorm weather comes, such that excessive rainfall can be prevented from accumulating in the center of the connecting base body to cause soil loosening and collapse. In addition, a service life of the fastening assembly is prolonged to a certain extent.

In the present disclosure, the protection assembly includes a first protection assembly. The first protection assembly is composed of two plate bodies, the two plate bodies are fixedly connected, and an included angle between the plate bodies is a right angle. A corner of the first protection assembly is provided with a second through hole, and a surface of the plate body is provided with a third through hole. A second protection assembly is arranged in the first protection assembly, and the second protection assembly is of a square frame body. A fourth through hole with the same diameter as the third through hole is provided in a surface of the second protection assembly, and the fourth through hole and the third through hole are coaxial.

Further, the protection assembly is fixedly connected to the connecting base body, and a screw rod is arranged in the second through hole in the first protection assembly. The screw rod can be firmly clamped in a first base body on a surface of the fastening assembly so as to play a reinforcing role. When a depth of the soil required for protection is relatively low, a considerable portion of the fastening assembly will be exposed to an external environment, which will accelerate the reduction of a service life of the fastening assembly. When landslide occurs, the fastening assembly the considerable portion of which is exposed will quite likely to fracture due to uneven stress of bolts inside and outside the soil. The first protection assembly is fixedly connected to the surface of the connecting base body, and the first protection assembly is fixedly connected to the second protection assembly through bolts. The first protection assembly and the second protection assembly surround an upper portion of the fastening assembly so as to achieve the purpose of protecting the fastening assembly. The screw rod on the first protection assembly can be aligned with a gap between various portions of a first base body so as to control the fastening assembly to accurately ensure the depth by which the fastening assembly is driven into the soil, such that each bolt can provide a considerable pre-tightening force, and partial soil is prevented from not being compacted and partial soil is prevented from being excessively compacted.

When a fastening base body is completely unfolded, the soil can give the fastening assembly a pushback force. The first protection assembly is fixedly connected to the connecting base body, and the counterweight of the first protection assembly is increased, such that the screw rod on the first protection assembly always abuts against the gap between various portions of the first base body in the form of downward pressing, so as to offset the pushback force received by the fastening assembly, thereby avoiding the screw rod of the first protection assembly from being offset due to the pushback force given by the first base body, and further avoiding loss of the function of controlling the fastening assembly.

In the present disclosure, the fastening assembly includes the first column body, and a nut is arranged at an upper end of the first column body in a sleeving manner. The first base body is arranged around a surface of the first column body, and the second column body is fixedly connected to a lower end of the first column body.

Further, the first base body has a multi-layer structure and is mainly used for firmly clamping the screw rod of the first protection assembly abutting against the first column body. The first base body is arranged on the surface of the first column body in a sleeving manner, and an upper end and a lower end of the first base body are fixedly connected to the nut and an end surface of the second column body respectively. An end portion of the nut is provided with a cross-shaped opening, and a tail portion of the nut is provided with a rotating shaft for urging the supporting rod to move.

In the present disclosure, a plurality of groove bodies are provided in a side of the second column body, supporting rods are arranged in the groove bodies, and bottoms of the supporting rods are fixedly connected to the second column body. Fastening base bodies are slidably connected to tops of the supporting rods, and bottoms of the fastening base bodies are rotationally connected to the second column body. A bolt head is arranged at a lower end of the second column body, and a blade-like cutting base body is arranged around a surface of the bolt head. The spiral blade-like structure at the top enables the bolt to be driven into the soil more easily and easily, which is conductive to tight abutment between the fastening assembly and the protection assembly. The bolt head is of a conical structure, and the cutting base body arranged around the bolt head can stir the surrounding soil, such that the excavated soil forms a space structure with a wide upper portion and a narrow lower portion, and a partial space is reserved for the fastening base body to be unfolded. The fastening base body is unfolded, and the surrounding soil is pushed to move, such that obstruction of the soil to the fastening base body can be reduced, and the conical structure formed by the soil is easier to partially accumulate downwards under a pushing action of the fastening base body, which ensures that the bolt head and the fastening base body are completely immersed in the soil to avoid gaps affecting the tightness of the connection.

When the nut is rotated, the rotating shaft at the tail portion of the nut drives the supporting rod to expand outwards or contract inwards. When the supporting rod is expanded outwards, the space inside the second column body is exposed and can be used for accumulating external soil so as to make the connection tighter. Moreover, an end portion of the supporting rod is connected to the fastening base body in the form of supporting plate sliding, such that the supporting rod can be protected from fracture when the supporting rod expands and contracts in the soil, simultaneously the supporting force received by the fastening base body can be increased, and the fastening base body can be completely unfolded in the soil. When the supporting rod contracts inwards, the rotating shaft at the tail portion of the nut rotates downwards to squeeze soil out of the groove body at a side edge of the second column body, so as to avoid the situation that the fastening base body cannot contract smoothly due to insufficient retreat space.

In the present disclosure, an end portion of a protection net is provided with a connecting assembly in a sleeved manner, the connecting assembly includes a first rotating column body, and two sides of the first rotating column body are rotationally connected to a first plate body. A plurality of connecting holes are provided in a surface of the first plate body, limiting grooves are provided between the connecting holes, and head portions and tail portions of the limiting grooves are connected to the connecting holes. In the present disclosure, the protection nets are connected through the connecting assemblies. Surfaces of the connecting holes abut against knots, connecting ropes are arranged between the knots, and the connecting ropes are arranged in the limiting grooves.

Further, the rotating column can enable each slope surface protection device to rotate relatively. The slope surface is not a flat plane, and the rotating column can ensure that the connection between the slope surface protection devices will not become loose due to the uneven slope surface, and the situation that the slope surface needing protection cannot be completely covered is avoided. The combination form of rope body crossing and abutting is employed for the protection net, and each net opening is of a rhombus, in which crops such as vegetation can be planted for soil reinforcement. The main purpose of the connecting assembly is that after the protection net is arranged, the protection net is usually in a tension state, and when the soil slides due to other factors, the connecting assembly rotates under force, such that the protection net forms a net pocket structure, and sliding soil and stones are caught, so as to avoid the protection net from being broken due to excessive tension.

Compared with the prior art, the present disclosure has the beneficial effects as follows: the fastening assembly is used for reinforcing the tightness of the contact between the connecting assembly and the soil, and the protection assembly is additionally arranged on the outer side of the fastening assembly, such that the protection assembly can accurately control the penetration depth of each bolt into the soil, and simultaneously can protect the surface of the fastening assembly and prolong the service life of the fastening assembly. The connecting assembly is used for ensuring that when landslide occurs on the slope surface, the protection net can be promoted to form a net pocket structure to net objects such as stones, so as to reduce loss and facilitate disassembly.

Figure 1:
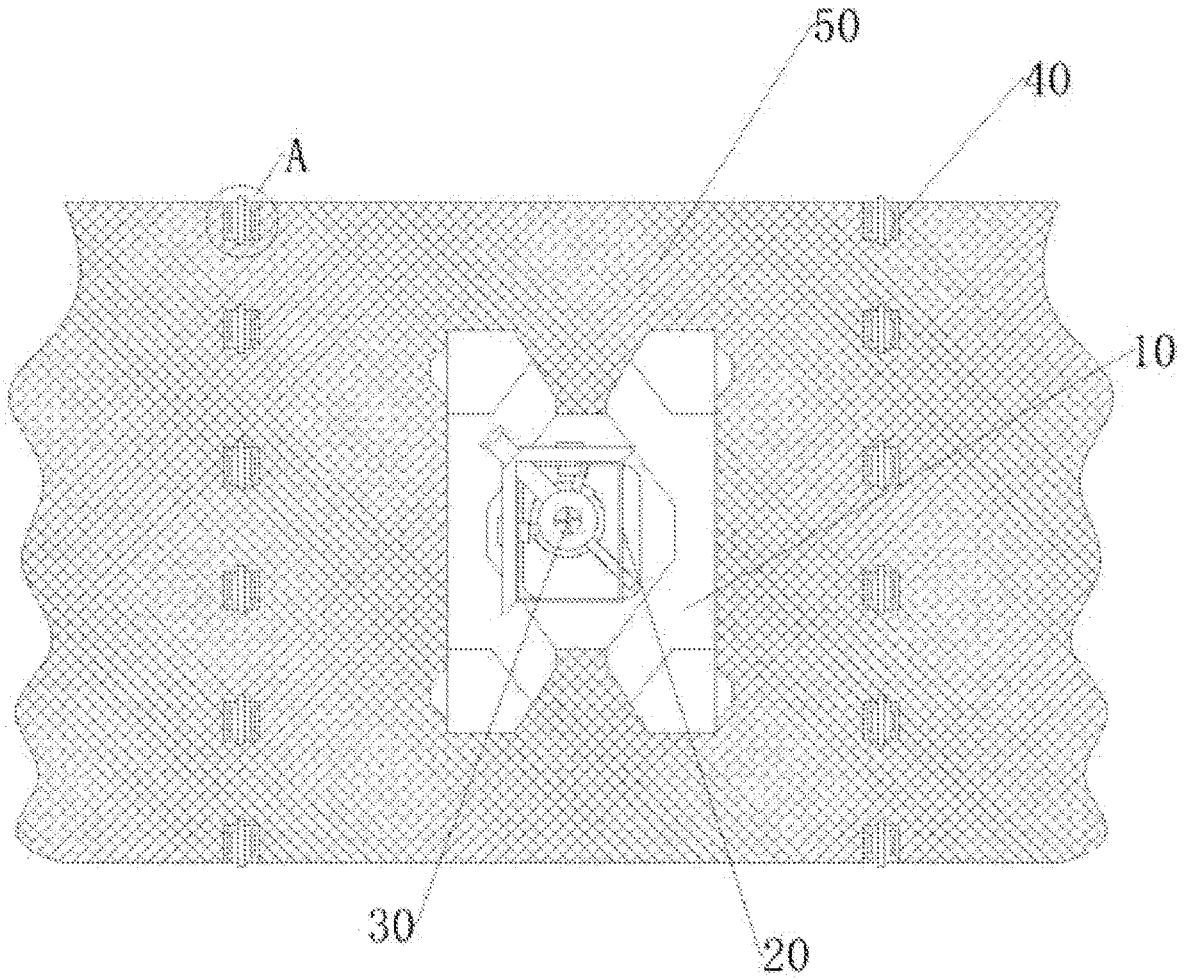
FIG. 1 is a schematic structural diagram of arrangement of a protection net related in the present disclosure.

Reference numerals in figures: 10—connecting assembly; 11—drainage groove; 12—notch; 13—retaining ring; 14—first through hole; 20—protection assembly; 21—first protection assembly; 211—second through hole; 212—third through hole; 22—second protection assembly; 221—fourth through hole; 30—fastening assembly; 31—nut; 32—first column body; 33—first base body; 34—second column body; 35—fastening base body; 36—supporting rod; 37—bolt head; 38—cutting base body; 40—connecting assembly; 41—first plate body; 42—connecting hole;

43—limiting groove; 44—rotating column; 50—protection net; 51—knot; and 52—connecting rope.

DETAILED DESCRIPTION OF THE EMBODIMENTS

Embodiment 1

Figure 2:
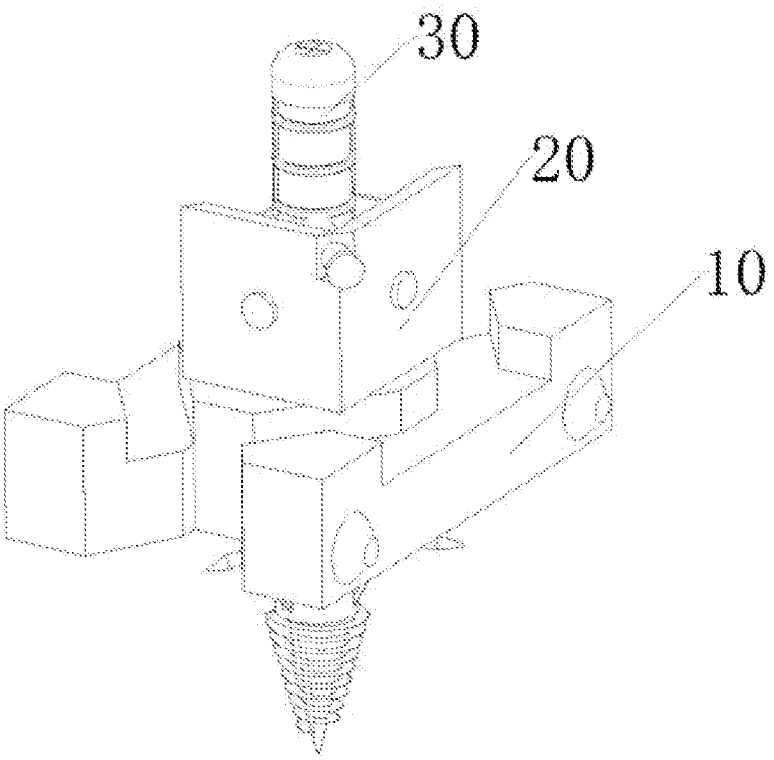
FIG. 2 is a schematic diagram of an integral structure of a slope reinforcing and protecting device for hydraulic engineering related in the present disclosure.
Figure 3:
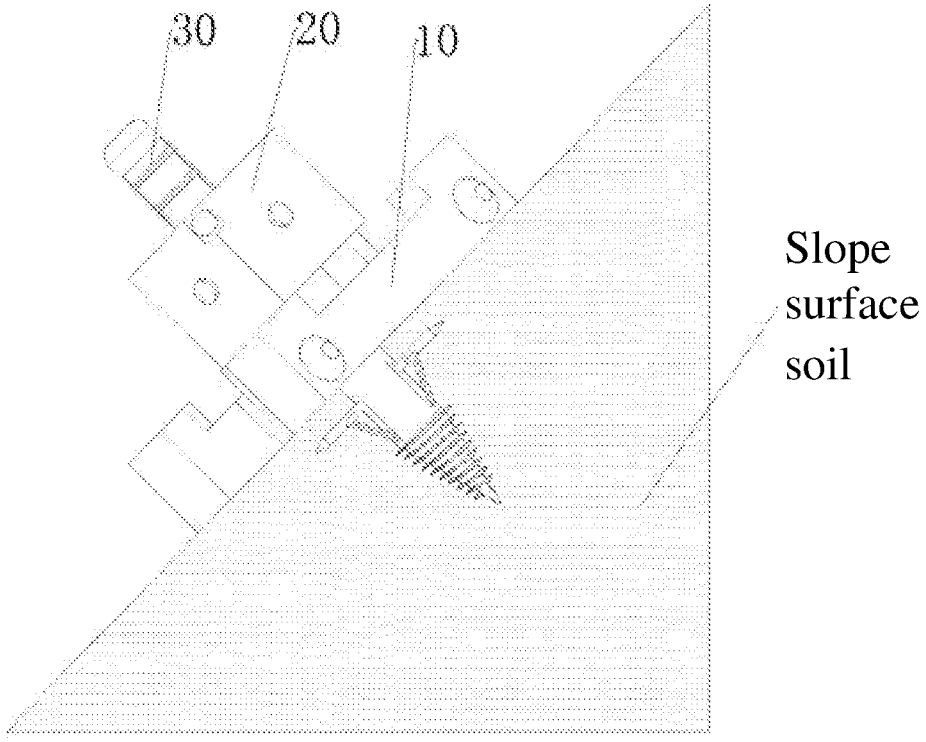
FIG. 3 is a schematic structural diagram from a side view of a slope reinforcing and protecting device for hydraulic engineering related in the present disclosure.

Referring to FIGS. 1, 2 and 3, a slope reinforcing and protecting device for hydraulic engineering is provided. The device includes a connecting base body 10. An upper end of the connecting base body 10 is fixedly connected to a protection assembly 20, a fastening assembly 30 is arranged in the protection assembly 20 for supporting, and a protection net 50 is connected around an outer side of the connecting base body 10. Further, a second column body 34 of the fastening assembly 30 is buried in soil, and a first column body 32 is partially exposed.

Figure 4:
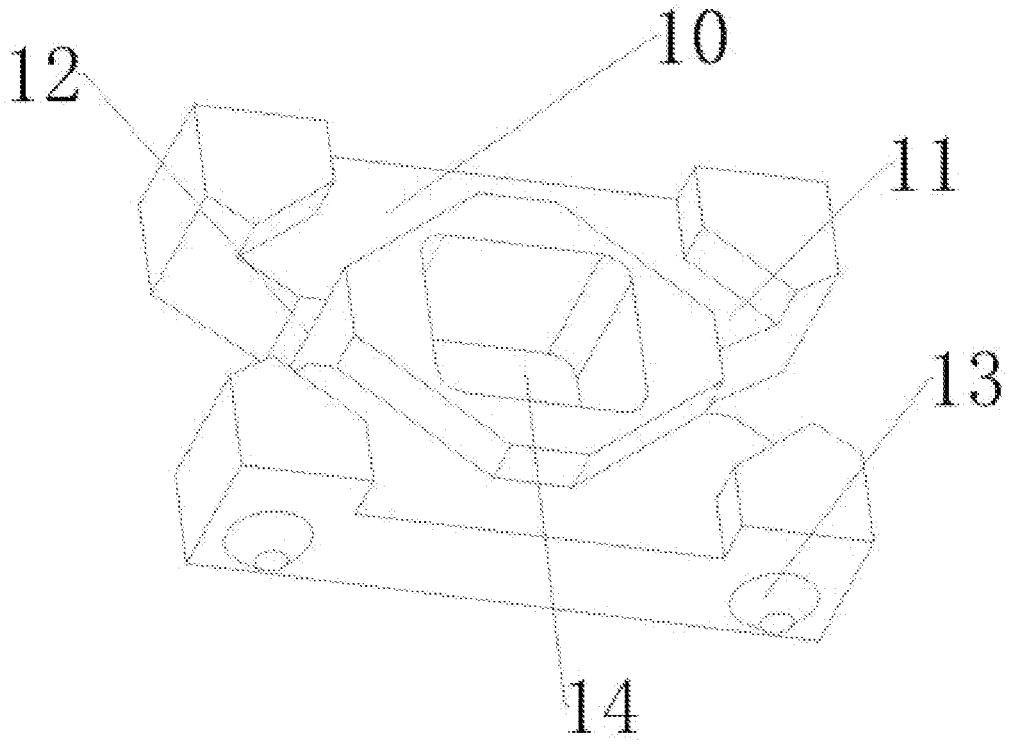
FIG. 4 is a schematic structural diagram of a connecting base body related in the present disclosure.

Referring to FIG. 4, the connecting base body 10 is shown. The connecting base body 10 is of a square body, and the center of the connecting base body is provided with an octagonal boss. The center of the boss is provided with a first through hole 14, the boss is at a certain angle, and a drainage groove 11 is provided around the first through hole 14. Trapezoidal notches 12 are provided in both sides of the connecting base body 10, and a plurality of retaining rings 13 are fixedly connected to a side edge of the connecting base body 10.

Further, water flow outlets of the drainage groove 11 in the surface of the connecting base body 10 are the notches 12 at two sides, and the purpose of arranging the drainage groove 11 is that rainwater can drop to the ground along the drainage groove 11 when rainstorm weather comes, such that excessive rainfall can be prevented from accumulating in the center of the connecting base body 10 to cause soil loosening and collapse. In addition, a service life of the fastening assembly 30 is prolonged to a certain extent.

Embodiment 2

Figure 5:
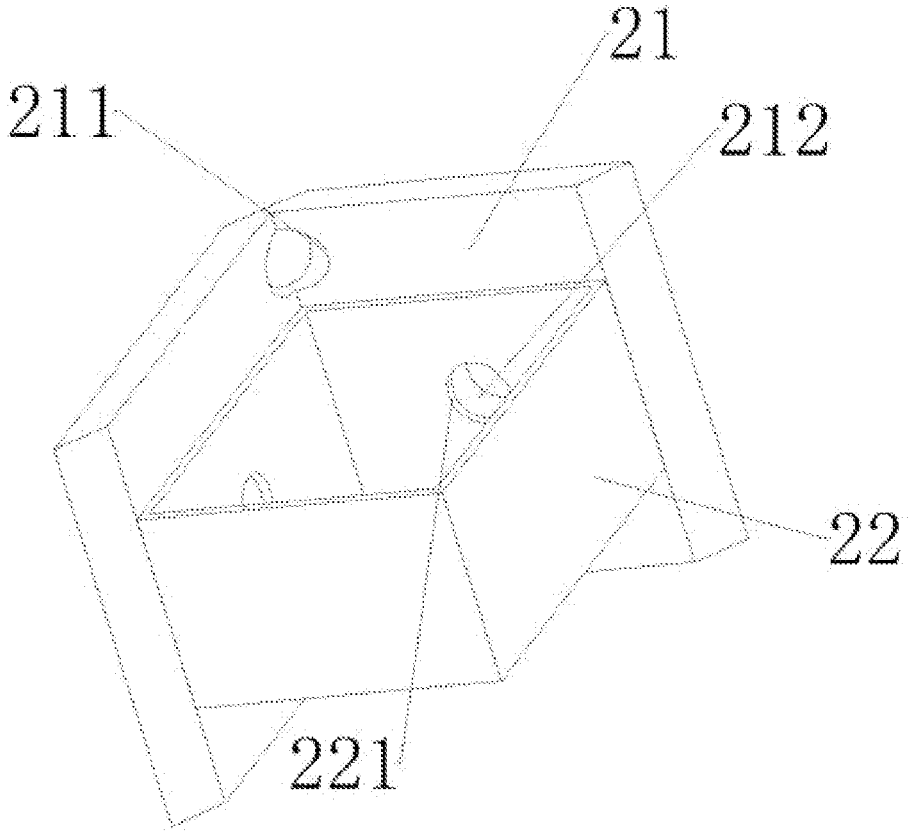
FIG. 5 is a schematic structural diagram of a protection assembly related in the present disclosure.

As shown in FIGS. 2 and 5, the difference between this embodiment and Embodiment 1 is that in the present disclosure, the protection assembly 20 includes a first protection assembly 21. The first protection assembly 21 is composed of two plate bodies, the two plate bodies are fixedly connected, and an included angle between the plate bodies is a right angle. A corner of the first protection assembly 21 is provided with a second through hole 211, and a surface of the plate body is provided with a third through hole 212. A second protection assembly 22 is arranged in the first protection assembly 21, and the second protection assembly 22 is of a square frame body. A fourth through hole 221 with the same diameter as the third through hole 212 is provided in a surface of the second protection assembly 22, and the fourth through hole 221 and the third through hole 212 are coaxial.

Referring to FIG. 2, Further, the protection assembly 20 is fixedly connected to the connecting base body 10, and a screw rod is arranged in the second through hole 211 in the first protection assembly 21. The screw rod can be firmly clamped in a first base body 33 on a surface of the fastening assembly 30 so as to play a reinforcing role. When a depth of the soil required for protection is relatively low, a considerable portion of the fastening assembly 30 will be exposed to an external environment, which will accelerate the reduction of a service life of the fastening assembly 30. When landslide occurs, the fastening assembly 30 the considerable portion of which is exposed will quite likely to fracture due to uneven stress of bolts inside and outside the soil. The first protection assembly 21 is fixedly connected to the surface of the connecting base body 10, and the first protection assembly 21 is fixedly connected to the second protection assembly 22 through bolts. The first protection assembly 21 and the second protection assembly 22 surround an upper portion of the fastening assembly 30 so as to achieve the purpose of protecting the fastening assembly 30. The screw rod on the first protection assembly 21 can be aligned with a gap between various portions of a first base body 33 so as to control the fastening assembly to accurately ensure the depth by which the fastening assembly 30 is driven into the soil, each bolt can provide a considerable pre-tightening force, and partial soil is prevented from not being compacted and partial soil is prevented from being excessively compacted.

Referring to FIG. 3, when a fastening base body 35 is completely unfolded, the soil can give the fastening assembly 30 a pushback force. The first protection assembly 21 is fixedly connected to the connecting base body 10, and the counterweight of the first protection assembly 21 is increased, such that the screw rod on the first protection assembly 21 always abuts against the gap between various portions of the first base body 33 in the form of downward pressing, so as to offset the pushback force received by the fastening assembly 30, thereby avoiding the screw rod of the first protection assembly 21 from being offset due to the pushback force given by the first base body 33, and further avoiding loss of the function of controlling the fastening assembly 30.

Figure 6:
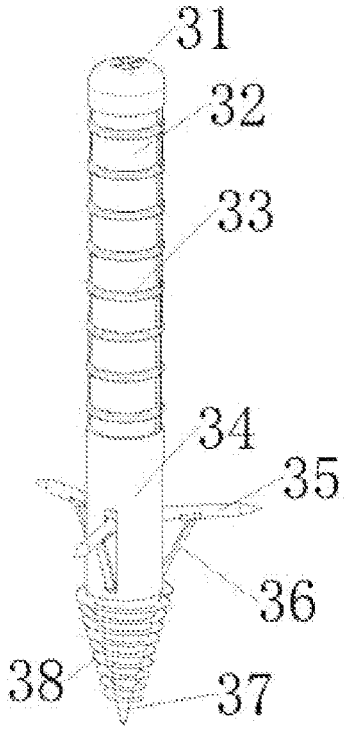
FIG. 6 is a schematic structural diagram of a fastening assembly related in the present disclosure.

Referring to FIG. 6, in the present disclosure, the fastening assembly 30 includes a first column body 32, and a nut 31 is arranged at an upper end of the first column body 32 in a sleeving manner. The first base body 33 is arranged around a surface of the first column body 32, and a second column body 34 is fixedly connected to a lower end of the first column body.

Further, the first base body 33 has a multi-layer structure and is mainly used for firmly clamping the screw rod of the first protection assembly 21 abutting against the first column body 32. The first base body 33 is arranged on the surface of the first column body 32 in a sleeving manner, and an upper end and a lower end of the first base body are fixedly connected to the nut 31 and an end surface of the second column body 34 respectively. An end portion of the nut 31 is provided with a cross-shaped opening, and a tail portion of the nut is provided with a rotating shaft for urging the supporting rod to move.

In the present disclosure, a plurality of groove bodies are provided in a side of the second column body 34, supporting rods 36 are arranged in the groove bodies, and bottoms of the supporting rods 36 are fixedly connected to the second column body 34. Fastening base bodies 35 are slidably connected to tops of the supporting rods 36, and bottoms of the fastening base bodies 35 are rotationally connected to the second column body 34. A bolt head 37 is arranged at a lower end of the second column body 34, and a blade-like cutting base body 38 is arranged around a surface of the bolt head 37. The spiral blade-like structure at the top enables the bolt to be driven into the soil more easily and easily, which is conductive to tight abutment between the fastening assembly 30 and the protection assembly 20. The bolt head 37 is of a conical structure, and the cutting base body 38 arranged around the bolt head 37 can stir the surrounding soil, such that the excavated soil forms a space structure with a wide upper portion and a narrow lower portion, and a partial space is reserved for the fastening base body 35 to be unfolded. The fastening base body 35 is unfolded, and the surrounding soil is pushed to move, such that obstruction of the soil to the fastening base body 35 can be reduced, and the conical structure formed by the soil is easier to partially accumulate downwards under a pushing action of the fastening base body 35, which ensures that the bolt head 37 and the fastening base body 35 are completely immersed in the soil to avoid gaps affecting the tightness of the connection.

When the nut 31 is rotated, the rotating shaft at the tail portion of the nut 31 drives the supporting rod 36 to expand outwards or contract inwards. When the supporting rod 36 is expanded outwards, the space inside the second column body 34 is exposed and can be used for accumulating external soil so as to make the connection tighter. Moreover, an end portion of the supporting rod 36 is connected to the fastening base body 35 in the form of supporting plate sliding, such that the supporting rod 36 can be protected from fracture when the supporting rod 36 expands and contracts in the soil, simultaneously the supporting force received by the fastening base body 35 can be increased, and the fastening base body 35 can be completely unfolded in the soil. When the supporting rod 36 contracts inwards, the rotating shaft at the tail portion of the nut 31 rotates downwards to squeeze soil out of the groove body at a side edge of the second column body 34, so as to avoid the situation that the fastening base body 35 cannot contract smoothly due to insufficient retreat space.

Embodiment 3

Figure 7:
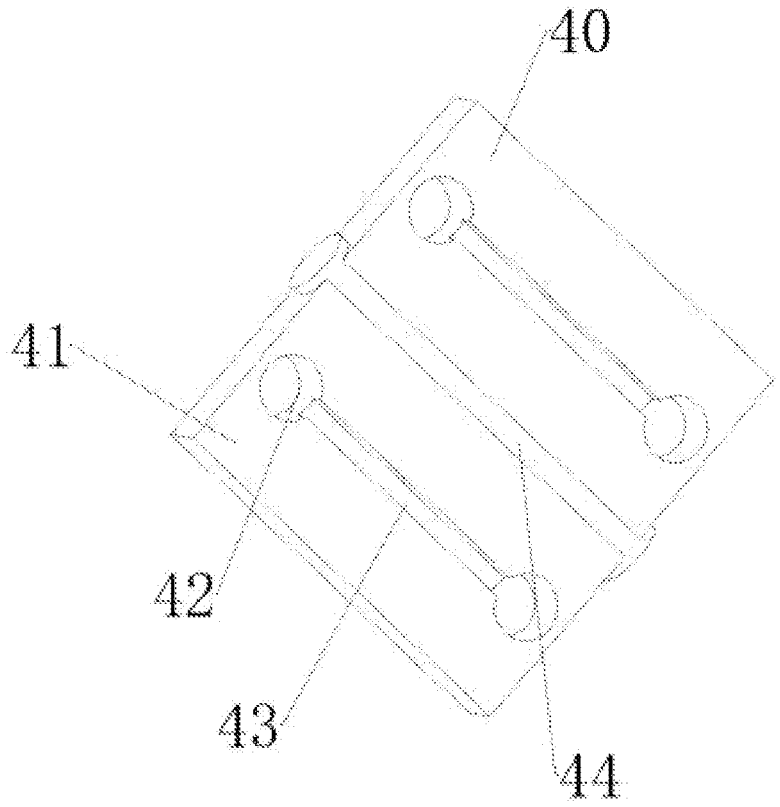
FIG. 7 is a schematic structural diagram of a connecting assembly related in the present disclosure.
Figure 8:
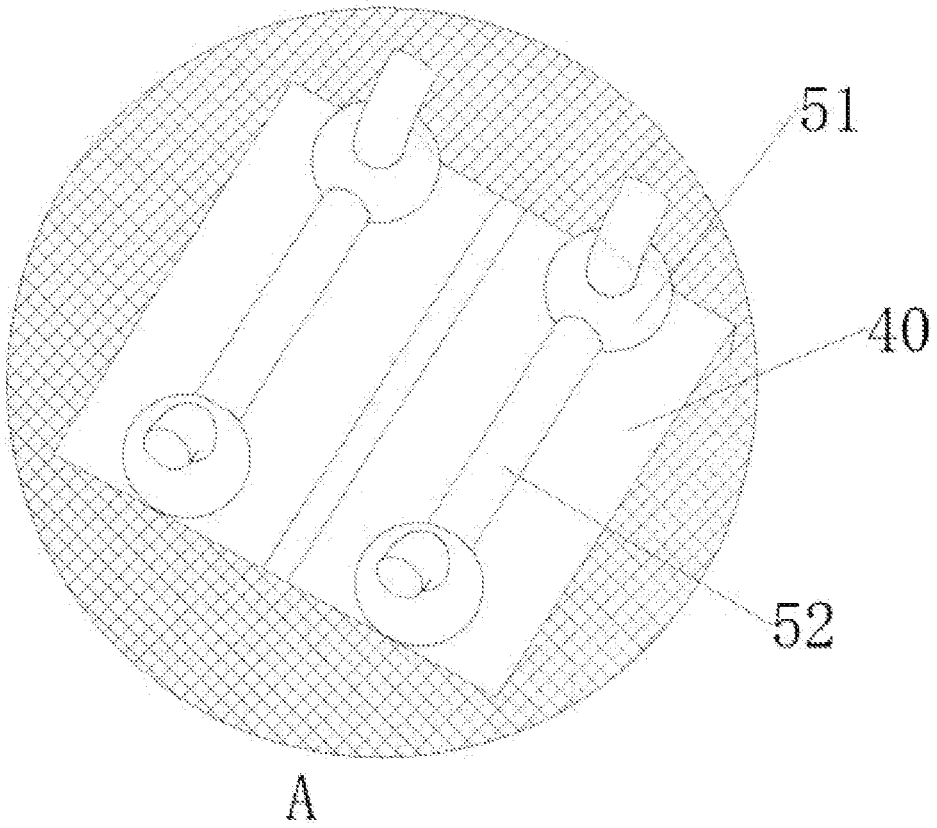
FIG. 8 is an enlarged schematic structural diagram of portion A in FIG. 1.

Referring to FIGS. 1, 7 and 8, the difference between this embodiment and Embodiment 1 is that in the present disclosure, an end portion of a protection net 50 is provided with a connecting assembly 40 in a sleeved manner, and the connecting assembly 40 includes a first rotating column body 44. Two sides of the first rotating column body 44 are rotationally connected to a first plate body 41, and a plurality of connecting holes 42 are provided in a surface of the first plate body 41. Limiting grooves 43 are provided between the connecting holes 42, and head portions and tail portions of the limiting grooves 43 are connected to the connecting holes 42. In the present disclosure, the protection nets 50 are connected through the connecting assemblies 40. Surfaces of the connecting holes 42 abut against knots 51, connecting ropes 52 are arranged between the knots 51, and the connecting ropes 52 are arranged in the limiting grooves 43.

Referring to FIGS. 1 and 8, Further, the rotating column 44 can enable each slope surface protection device to rotate relatively. The slope surface is not a flat plane, and the rotating column 44 can ensure that the connection between the slope surface protection devices will not become loose due to the uneven slope surface, and the situation that the slope surface needing protection cannot be completely covered is avoided. The combination form of rope body crossing and abutting is employed for the protection net 50, and each net opening is of a rhombus, in which crops such as vegetation can be planted for soil reinforcement. The main purpose of the connecting assembly 40 is that after the protection net 50 is arranged, the protection net 50 is usually in a tension state, and when the soil slides due to other factors, the connecting assembly rotates under force, such that the protection net 50 forms a net pocket structure, and sliding soil and stones are caught, so as to avoid the protection net 50 from being broken due to excessive tension.

Various technical features of the embodiments mentioned above may be arbitrarily combined. To simplify description, all possible combinations of the various features of the embodiments mentioned above are not described. However, if only the combinations of these technical features do not conflict, they shall be considered to be within the scope of description of the present disclosure.

The embodiments mentioned above are merely several embodiments of the present disclosure, and are specifically described in details, but may not be interpreted as limiting the scope of the patent for the present disclosure as a result. It shall be noted that for those of ordinary skill in the field, they may also make several transformations and improvements on the premise of not deviating from the conception of the present disclosure, and these transformations and improvements shall fall within the scope of protection of the present disclosure. Hence, the scope of protection of the patent for the present disclosure shall be subject to the appended claims.

What is claimed is:

1. A slope reinforcing and protecting device for hydraulic engineering, the slope reinforcing and protecting device comprising a connecting base body (10), wherein an upper end of the connecting base body (10) is fixedly connected to a protection assembly (20), a fastening assembly (30) is arranged in the protection assembly (20), and a protection net (50) is connected around an outer side of the connecting base body (10); and the protection assembly (20) comprises a first protection assembly (21), the first protection assembly (21) is composed of two plate bodies, the two plate bodies are fixedly connected, and an included angle between the plate bodies is a right angle; a corner of the first protection assembly (21) is provided with a second through hole (211), and a surface of each of the two plate bodies is provided with a third through hole (212); a second protection assembly (22) is arranged in the first protection assembly (21), and the second protection assembly (22) is of a square frame body; a fourth through hole (221) with the same diameter as the third through hole (212) is provided in a surface of the second protection assembly (22), and the fourth through hole (221) and the third through hole (212) are coaxial; and the first protection assembly (21) and the second protection assembly (22) are fixedly connected through rivets.

2. The slope reinforcing and protecting device for hydraulic engineering according to claim 1, wherein a first through hole (14) is provided in a center of the connecting base body (10), a drainage groove (11) is provided around the first through hole (14), trapezoidal notches (12) are provided in both sides of the connecting base body (10), and a plurality of retaining rings (13) are fixedly connected to a side edge of the connecting base body (10).

3. The slope reinforcing and protecting device for hydraulic engineering according to claim 1, wherein the fastening assembly (30) comprises a first column body (32), a nut (31) is arranged at an upper end of the first column body (32) in a sleeving manner, a first base body (33) is arranged around a surface of the first column body (32), and a second column body (34) is fixedly connected to a lower end of the first column body (32).

4. The slope reinforcing and protecting device for hydraulic engineering according to claim 3, wherein a plurality of groove bodies are provided in a side of the second column body (34), supporting rods (36) are arranged in the groove bodies, bottoms of the supporting rods (36) are fixedly connected to the second column body (34), fastening base bodies (35) are slidably connected to tops of the supporting rods (36), bottoms of the fastening base bodies (35) are rotationally connected to the second column body (34), a bolt head (37) is arranged at a lower end of the second column body (34), and a cutting base body (38) is arranged around a surface of the bolt head (37).

5. A slope reinforcing and protecting device for hydraulic engineering, the slope reinforcing and protecting device comprising a connecting base body (10), wherein an upper end of the connecting base body (10) is fixedly connected to a protection assembly (20), a fastening assembly (30) is arranged in the protection assembly (20), and a protection net (50) is connected around an outer side of the connecting base body (10); and an end portion of the protection net (50) is provided with a connecting assembly (40) in a sleeved manner, the connecting assembly (40) comprises a first rotating column body (44), two sides of the first rotating column body (44) are rotationally connected to a first plate body (41), a plurality of connecting holes (42) are provided in a surface of the first plate body (41), limiting grooves (43) are provided between the connecting holes (42), and head portions and tail portions of the limiting grooves (43) are connected to the connecting holes (42).

6. The slope reinforcing and protecting device for hydraulic engineering according to claim 5, wherein surfaces of the connecting holes (42) abut against knots (51), connecting ropes (52) are arranged between the knots (51), and the connecting ropes (52) are arranged in the limiting grooves (43).

7. The slope reinforcing and protecting device for hydraulic engineering according to claim 5, wherein a first through hole (14) is provided in a center of the connecting base body (10), a drainage groove (11) is provided around the first through hole (14), trapezoidal notches (12) are provided in both sides of the connecting base body (10), and a plurality of retaining rings (13) are fixedly connected to a side edge of the connecting base body (10).

8. The slope reinforcing and protecting device for hydraulic engineering according to claim 5, wherein the protection assembly (20) comprises a first protection assembly (21), the first protection assembly (21) is composed of two plate bodies, the two plate bodies are fixedly connected, and an included angle between the plate bodies is a right angle; a corner of the first protection assembly (21) is provided with a second through hole (211), and a surface of each of the two plate bodies is provided with a third through hole (212); a second protection assembly (22) is arranged in the first protection assembly (21), and the second protection assembly (22) is of a square frame body; a fourth through hole (221) with the same diameter as the third through hole (212) is provided in a surface of the second protection assembly (22), and the fourth through hole (221) and the third through hole (212) are coaxial; and the first protection assembly (21) and the second protection assembly (22) are fixedly connected through rivets.

9. The slope reinforcing and protecting device for hydraulic engineering according to claim 5, wherein the fastening assembly (30) comprises a first column body (32), a nut (31) is arranged at an upper end of the first column body (32) in a sleeving manner, a first base body (33) is arranged around a surface of the first column body (32), and a second column body (34) is fixedly connected to a lower end of the first column body (32).

10. The slope reinforcing and protecting device for hydraulic engineering according to claim 9, wherein a plurality of groove bodies are provided in a side of the second column body (34), supporting rods (36) are arranged in the groove bodies, bottoms of the supporting rods (36) are fixedly connected to the second column body (34), fastening base bodies (35) are slidably connected to tops of the supporting rods (36), bottoms of the fastening base bodies (35) are rotationally connected to the second column body (34), a bolt head (37) is arranged at a lower end of the second column body (34), and a cutting base body (38) is arranged around a surface of the bolt head (37).

* * * * *